US009270072B2

(12) United States Patent
Westley et al.

(10) Patent No.: US 9,270,072 B2
(45) Date of Patent: Feb. 23, 2016

(54) DIELESS CRIMPING TOOL

(75) Inventors: Todd Westley, Elyria, OH (US); Robert M. Baracskai, North Ridgeville, OH (US)

(73) Assignee: Emerson Electric Co., St. Louis, MO (US)

( * ) Notice: Subject to any disclaimer, the term of this patent is extended or adjusted under 35 U.S.C. 154(b) by 574 days.

(21) Appl. No.: 13/540,763

(22) Filed: Jul. 3, 2012

(65) Prior Publication Data

US 2014/0007642 A1 Jan. 9, 2014

(51) Int. Cl.
*H01R 43/042* (2006.01)

(52) U.S. Cl.
CPC ..... *H01R 43/0424* (2013.01); *H01R 43/0427* (2013.01)

(58) Field of Classification Search
CPC ..... H01R 43/0424; H01R 43/0427; H01R 43/04; H01R 43/028; B21D 39/04; B21D 39/08; B21D 37/04; B21D 27/06; F16L 13/141; F16L 29/282; B25B 5/00; B25B 5/006; B25B 5/02; B25B 5/16
USPC ..... 72/402, 407, 416, 463, 482.91, 482.92; 81/301, 57.16, 57.34, 57.18, 57.19, 81/57.2
See application file for complete search history.

(56) References Cited

U.S. PATENT DOCUMENTS

| | | | | |
|---|---|---|---|---|
| 2,182,663 | A * | 12/1939 | Eby et al. | 29/517 |
| 2,722,859 | A * | 11/1955 | Stoltz | 72/409.01 |
| 3,154,981 | A * | 11/1964 | McDurmont | 72/402 |
| 3,575,036 | A * | 4/1971 | Hoffman et al. | 72/402 |
| 4,261,194 | A * | 4/1981 | Stephens | 72/402 |
| 5,007,280 | A * | 4/1991 | Quinn et al. | 72/402 |
| 5,257,525 | A * | 11/1993 | Clarke | 72/402 |
| 5,335,530 | A * | 8/1994 | Homm | 72/402 |
| 5,934,136 | A * | 8/1999 | Bracher et al. | 72/397 |
| 6,230,542 | B1 | 5/2001 | Frenken | |
| 6,324,884 | B1 | 12/2001 | Barjesteh et al. | |
| 6,966,230 | B2 | 11/2005 | Frenken | |
| 6,990,843 | B2 | 1/2006 | Frenken | |
| 2008/0295565 | A1 | 12/2008 | Boemmels et al. | |
| 2011/0197648 | A1* | 8/2011 | Houser et al. | 72/452.1 |

FOREIGN PATENT DOCUMENTS

| | | | |
|---|---|---|---|
| CA | 2077573 | | 3/1993 |
| DE | 10100398 | A1 * | 7/2002 |

OTHER PUBLICATIONS

International Search Report (ISR), PCT/US2013/046360, Jun. 18, 2013, 3 Pages.

* cited by examiner

*Primary Examiner* — Shelley Self
*Assistant Examiner* — Peter Iannuzzi
(74) *Attorney, Agent, or Firm* — Mark E. Bandy; Rankin, Hill & Clark LLP

(57) ABSTRACT

A tool having a selectively positionable latch which governs access to an interior working region of the tool is described. The latch is selectively positionable between a closed position and an open position. For tools having multiple indenters for performing crimping operations, the latch can also include an indenter.

18 Claims, 6 Drawing Sheets

DIELESS CRIMPING TOOL

FIELD

The present subject matter relates to a dieless crimping tool, and particularly to a four point indenter dieless crimping tool.

BACKGROUND

Crimping tools are known which include multiple members or "indenters" that, upon activation of the tool, are urged against a member to be crimped such as a wire lug. Typically, such tools include four (4) indenters that are each directed radially inward. Upon tool activation, three (3) of the indenters are radially displaced toward the crimp target. The fourth indenter is stationary. The general assembly for this type of tool is described and illustrated in U.S. Pat. No. 3,154,981.

After the '981 patent, some tools of this type included a latch which could be selectively opened or closed to govern access to the region at which crimping occurs. In certain versions of these tools, the positionable latch incorporated the fourth indenter.

Although satisfactory in certain regards, tools of this type have relatively thick nose regions resulting from the size of the latch. As a result, such tools have limited ability to be used in compact or "tight" spaces. In addition, the relatively large swing radius of the latch in such tools further limits their use. Accordingly, a need remains for a crimping tool that avoids these problems.

SUMMARY

The difficulties and drawbacks associated with previously known tools are overcome in the present subject matter.

In one aspect, the present subject matter provides a tool head comprising a frame assembly defining an interior hollow region and a passage extending between the interior region and an exterior of the frame assembly. The passage provides access to the interior region. The frame assembly includes a first latch pin and a second latch pin. The pins are disposed opposite one another and separated by the passage. The tool head also comprises a selectively positionable latch retained along the frame assembly and proximate the passage and governing access to the interior region. The latch has a first end and a second end, an exterior face generally extending between the first end and the second end, and an interior face oppositely directed from the exterior face and generally extending between the first end and the second end. The latch defines an open aperture proximate the first end and a closed aperture proximate the second end. The latch is positionably retained along the frame assembly and proximate the passage by the second pin disposed in the closed aperture and the first pin disposed in the open aperture. The latch is positionable between (i) an unsecured position in which the first pin is not disposed in the open aperture and the second pin is disposed in the closed aperture, and (ii) a closed position in which the first pin is disposed in the open aperture and the second pin is disposed in the closed aperture.

In another aspect, the present subject matter provides a tool head having a plurality of moveable indenters which are displaced toward one another upon operation of the tool head. The tool head comprises a frame assembly defining an interior hollow region and a passage extending between the interior hollow region and an exterior of the frame assembly. The tool head also comprises first and second latch pins extending from the frame assembly and disposed on opposite sides of the passage. The tool head also comprises a selectively positionable latch defining a closed aperture within which the second latch pin is disposed and an open aperture within which the first latch pin can be disposed. The latch can be positioned between (i) a closed position in which the latch extends across the passage and the first latch pin is disposed in the open aperture, and (ii) an unsecured position in which the first latch pin is not disposed in the open aperture.

In yet another aspect, the present subject matter provides a tool head having provisions for performing a crimping or pressing operation upon a workpiece. The tool head comprises a frame assembly defining an interior region for performing a crimping or pressing operation. The frame assembly also defines an access channel extending between the interior region and a nose region of the frame assembly. The tool head also comprises at least one latch pin secured to the frame assembly and positioned proximate the access channel defined by the frame assembly. And, the tool head also comprises a selectively positionable latch defining at least one elongate aperture having two opposite endwalls and sized to receive at least one latch pin. The latch is positioned such that the latch pin is received within the aperture defined in the latch and the latch is positionable between (i) a closed position in which the latch extends across the access channel thereby blocking the access channel and the latch pin contacts one of the endwalls of the aperture defined in the latch, (ii) an unsecured position in which the latch pin contacts another one of the endwalls of the aperture defined in the latch, and (iii) an open position in which the access channel defined by the frame assembly is not blocked by the latch.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

The present subject matter provides in part, a tool having a particular latch configuration, and an assembly for opening and closing the latch when incorporated along the nose region of the tool. As shown in the noted figures and as described in greater detail herein, a selectively positionable latch is retained along a nose region of a tool head by a pair of pins. One pin is received in an open slot on one end of the latch. The other pin is received in a closed slot and thus "trapped" within the other end of the latch. The latch is "opened" by moving the latch relative to the pins so that the trapped pin is displaced from one end of the closed slot to the other end of the closed slot. Such movement causes the other pin to be released or freed from the open slot of the latch. The latch can then be pivoted about the trapped pin. The latch may also include a blind hole accessible from the closed slot. A compression spring can be located in the blind hole and extend between the latch (via the endwall of the blind hole) and the trapped pin. The spring serves to bias the latch to a "closed" position. The latch also includes an indenter, i.e. the fourth indenter, for tools of this type. The latch may also include a removable knob to facilitate grasping of the latch by a user. The knob can be removed if the tool is being used in a tight area.

Figure 1:
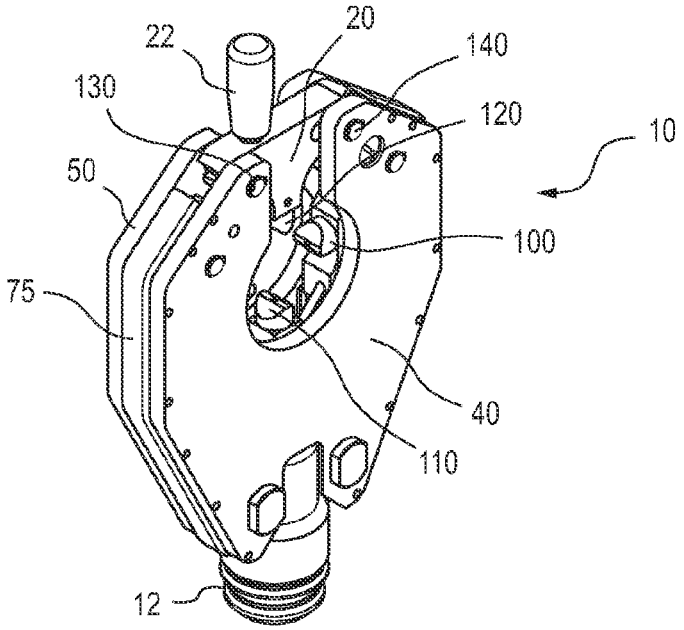
FIG. 1 is a front perspective view of a head of a dieless crimping tool with an optional latch handle in accordance with the present subject matter.

FIG. 1 illustrates a tool head 10 according to the present subject matter. The tool head 10 comprises a latch 20 selectively positionable between two frame members such as a first frame member 40 and a second frame member 50. The latch 20 may include an optional grip member 22 extending therefrom. Typically, each of the frame members 40, 50 are formed from high strength materials such as steel or aluminum. The frame members in the embodiment shown are spaced apart and oriented generally parallel to one another, however the present subject matter includes a wide array of other configurations and arrangements. The frame members 40, 50 can be spaced apart by one or more sidewalls 75 disposed between the frame members. The tool head 10 also comprises an engagement assembly generally denoted as 12 in the referenced figures. The engagement assembly 12 is used for attaching or coupling the tool head 10 to a tool body as described in greater detail herein. Each frame member 40, 50 defines an interior access region within which a plurality of indenters reside or are accessible. The particular embodiment of tool head 10 depicted in the referenced figures comprises a pair of opposing indenters and typically slidable indenters such as indenters 90 (not shown in FIGS. 1) and 100. The tool head 10 also comprises a primary indenter 110 and an opposing supplemental indenter 120 engaged or otherwise associated with the latch 20. Each of the indenters 90, 100, 110, and 120 and their operation are described in greater detail herein. Latch pins 130 and 140 extend between the frame members 40 and 50. These aspects are all described in greater detail herein.

Figure 2:
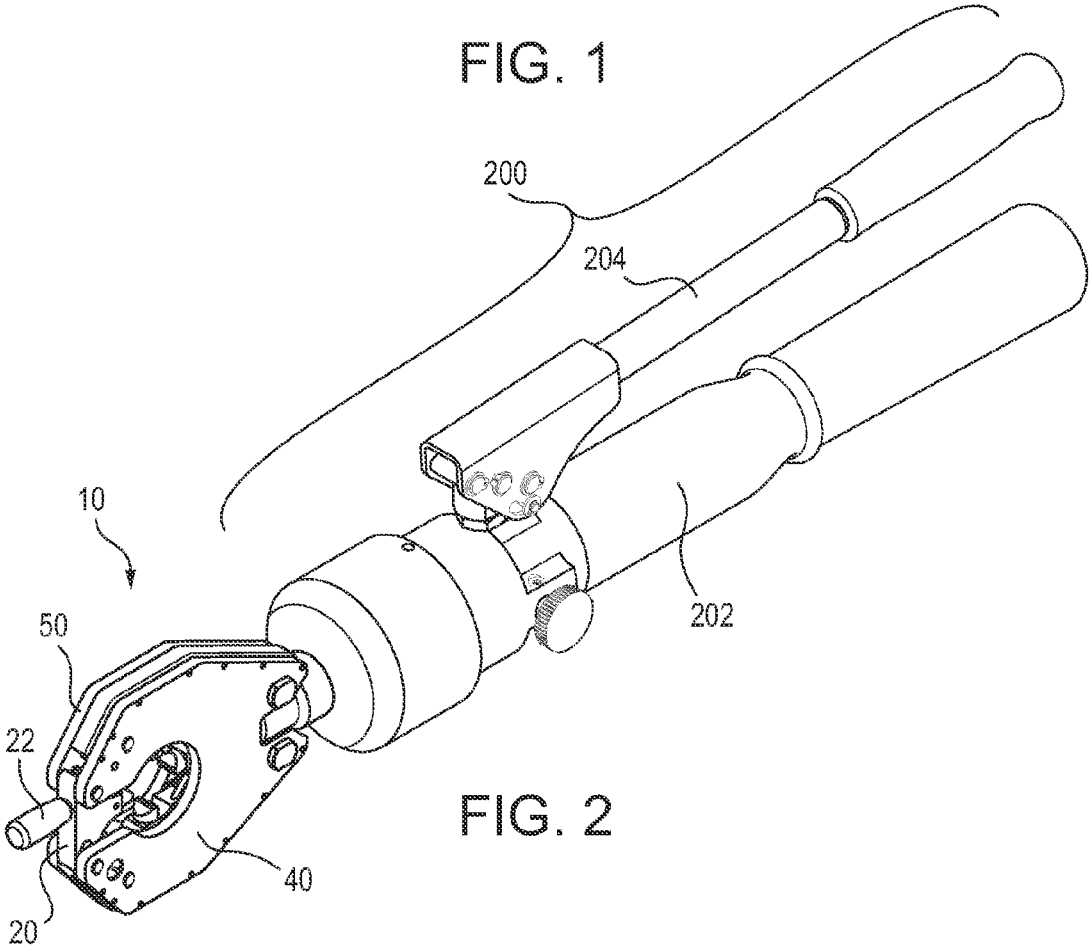
FIG. 2 is a perspective view of a manually operated crimping tool using the head depicted in FIG. 1.

FIG. 2 illustrates the tool head 10 of FIG. 1 engaged to a tool 200 which can be in a variety of different configurations and sizes. The tool 200 depicted in FIG. 2 is a hand held tool which is manually actuated by pivotal movement of an actuator handle 204 relative to a tool body 202. It will be appreciated that the tool heads of the present subject matter can be used in combination with powered tools and tool systems. Moreover, although the tool heads of the present subject matter are primarily contemplated for use with hydraulic tools, both manual and powered; it will be understood that the tool heads could also be adapted for use with tools or tool systems that do not utilize hydraulics.

Figure 5:
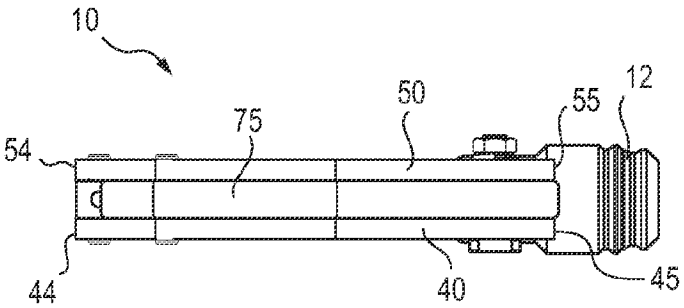
FIG. 5 is a top view of the tool head of FIG. 3.
Figure 6:
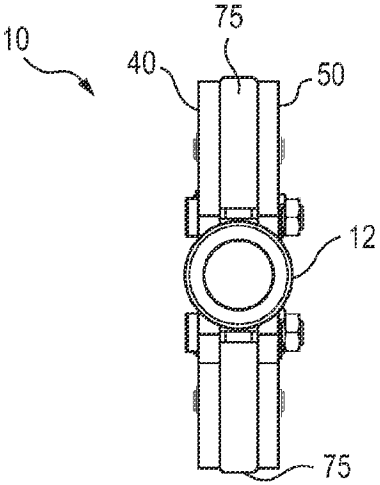
FIG. 6 is a rear end view of the tool head of FIG. 3.
Figure 3:
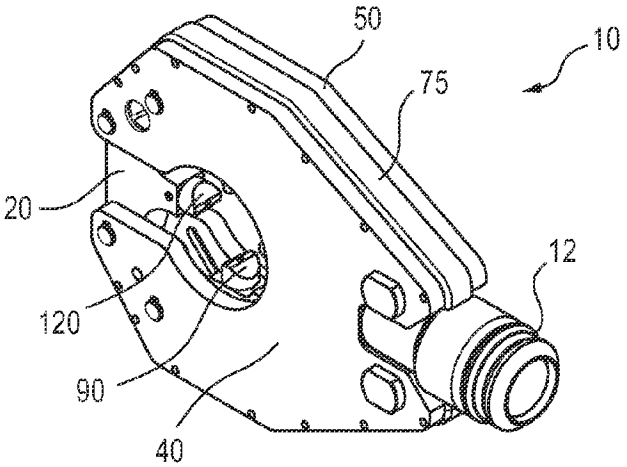
FIG. 3 is a rear perspective view of the tool head illustrated in FIG. 1 without the optional latch handle.
Figure 4:
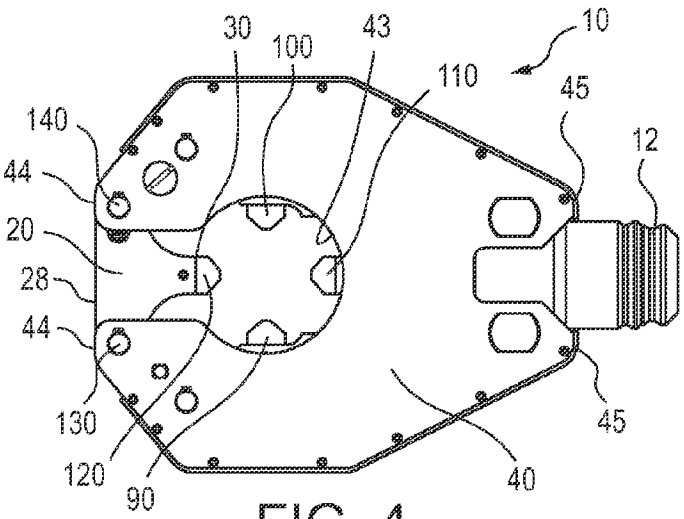
FIG. 4 is a side elevational view of the tool head of FIG. 3.

FIGS. 3-6 are various views of the tool head 10 of the present subject matter. Specifically, FIG. 3 is a rear perspective view of the tool head 10 without the optional grip member 22 extending from the latch 20. FIG. 4 is a side elevational view of the tool head 10 of FIG. 3. FIG. 5 is a top view of the tool head of FIG. 3. And, FIG. 6 is a rear end view of the tool head of FIG. 3. Additional details and aspects of the tool head 10 are depicted in FIG. 4. The frame member 40 defines a corresponding nose end 44 and an oppositely located rear end 45. The rear end 45 is proximate to the engagement assembly 12. The frame member 50 (not shown in FIG. 4) includes similar regions such as a nose end 54 and a rear end 55 as shown in FIG. 5. The latch 20 defines a forwardly directed nose surface 28 and an oppositely directed rear surface 30. The latch is engaged or otherwise engageable with a plurality of latch pins such as a first latch pin 130 and a second latch pin 140. The frame member 40 defines an interior access region 43 within which are generally disposed a plurality of indenters such as indenters 90, 100, 110, and 120.

Figure 9:
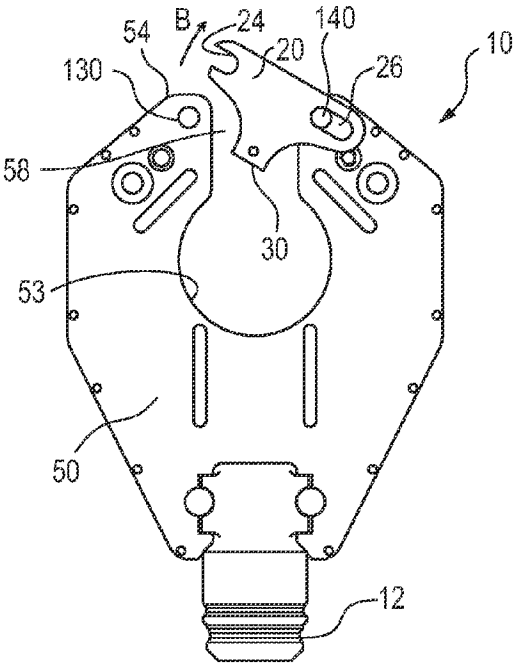
FIGS. 7-9 are side elevational views of the tool head revealing an interior region and a selectively positionable latch.
Figure 8:
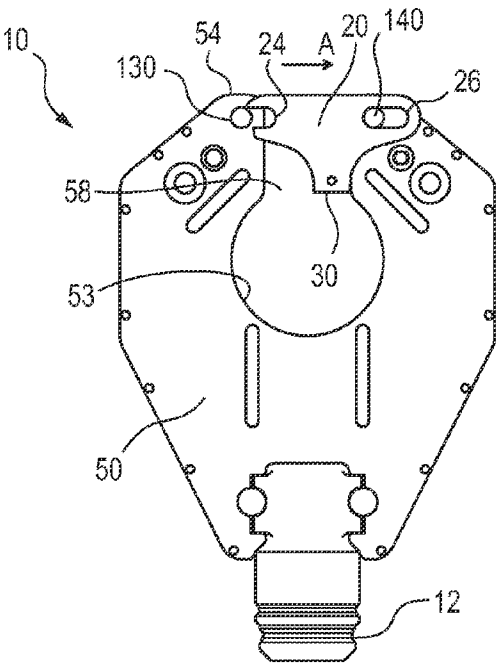
Figure 7:
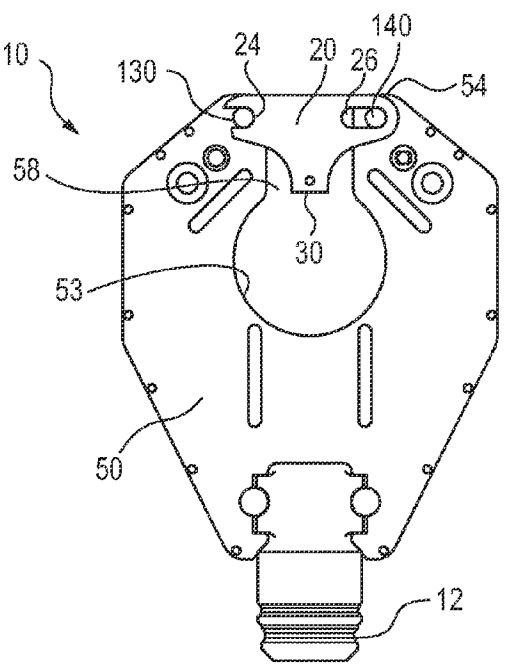
Figure 10:
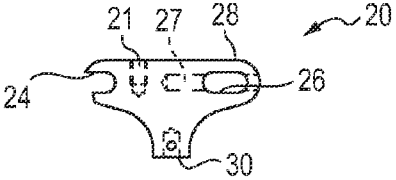
FIG. 10 is a detailed view of the selectively positionable latch utilized in the tool head of the present subject matter.

FIGS. 7-9 illustrate engagement between the latch 120 and the frame members. For purposes of illustration, only one of the frame members is shown, i.e. frame member 50. Before describing engagement and operation of the latch 20, it is instructive to review a particular configuration for the latch 20. FIG. 10 is a detailed view of the latch 20. The latch 20 defines a forwardly directed nose surface 28 and an oppositely directed rear surface 30. The latch defines an open slot 24 accessible along a first lateral end of the latch, and a closed slot 26 which is generally defined proximate an opposite lateral end. In certain embodiments of the present subject matter, the open slot 24 includes an inner arcuate wall that extends between a front wall and a rear wall. The front wall of the open slot 24 is proximate and generally parallel to the nose surface 28 of the latch 20. The rear wall of the open slot 24 is generally parallel to the front wall of the open slot 24. Collectively, the front wall, the inner arcuate wall, and the rear wall of the open slot 24 define the open slot 24. In certain embodiments, the front wall of the open slot 24 has a greater length than the rear wall of the open slot 24. Furthermore, in certain embodiments of the present subject matter, the closed slot 26 is in the form of an elongated slot and includes a pair of arcuate end walls directed toward each other, and a front wall and a rear wall directed toward each other and extending between the pair of arcuate end walls. In certain versions, the front wall of the closed slot 26 (disposed proximate and generally parallel to the nose surface 28 of the latch 20), is parallel to the rear wall of the closed slot 26.

The latch 20 may optionally include an aperture 21 or mounting region accessible along the nose surface 28 for receipt of the optional grip member 22 (shown in FIGS. 1 and 2). The latch 20 may also optionally define a blind hole accessible along an interiorly disposed wall of the closed slot 26, such as blind hole 27 depicted in FIG. 10. The blind hole 27 in certain versions of the subject matter, receives a biasing element such as a compression spring. This aspect is described in greater detail herein.

FIGS. 7-9 illustrate the tool head 10 having one of the frame members removed, i.e. frame member 40, to reveal the latch 20, the latch pins 130 and 140, and their relationship with slots or apertures 24 and 26 defined in the latch 20. FIG. 7 depicts the latch 20 in a "closed" position such that access to an interior access region 53 is precluded via an access channel 58 extending between the interior region 53 and a nose end 54 of the frame member 50. In the closed position, the latch 20 is disposed relative to the frame member 50 and the latch pins 130, 140 secured thereto such that the first latch pin 130 is received or captured within the open slot 24 and the second latch pin 140 is received or captured within the closed slot 26. In certain versions of the present subject matter and as shown in FIG. 7, in the closed position, both latch pins 130 and 140 are received in corresponding slots 24 and 26, respectively, and are in contact with an end wall of each slot. Also, in certain versions of the present subject matter, and as depicted in FIG. 7, the latch 20 is centrally disposed relative to the access channel, such as channel 58 of the frame member 50. As noted, the latch 20 may include a blind hole 27 within which is disposed a biasing member such as a compression spring. In certain versions of the present subject matter, the use of such provisions promotes positioning of the latch 20 to a closed position due to the biasing member or spring contacting the second latch pin 140 and urging of the latch 20 away from the pin 140. This results in establishing and maintaining contact between the latch pins 130, 140 and corresponding end walls within the slots 24, 26 as shown in FIG. 7.

The latch 20 can be moved or positioned to an "unsecured" position by laterally displacing the latch 20 relative to the latch pins 130, 140 and the frame member(s) by moving the latch 20 in the direction of arrow A as depicted in FIG. 8. Lateral movement occurs until the second latch pin 140 contacts an opposite endwall of the closed slot 26 as shown in FIG. 8. Upon establishing this position, the first latch pin 130 is freed or no longer received within the open slot 24 of the latch 20 as shown in FIG. 8. In the unsecured latch position depicted in FIG. 8, the second latch pin 140 is disposed in the closed slot 26.

Once the latch 20 is positioned to the unsecured position depicted in FIG. 8, the latch 20 can be positioned to an "open" position by pivoting the latch 20 about the second latch pin 140 in the direction of arrow B as shown in FIG. 9. The latch 20 can be further pivoted in the direction of arrow B beyond the position shown in FIG. 9 to enable full access via the channel 58 to the interior region 53 of the frame member 50.

Figure 11:
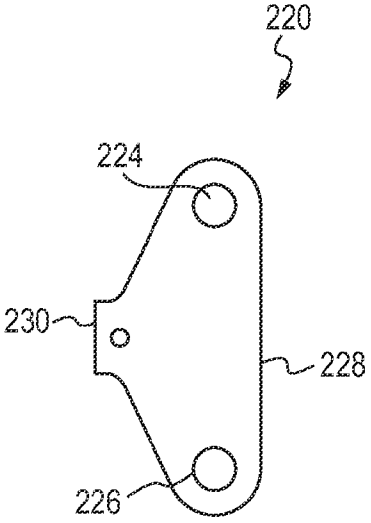
FIG. 11 is a side elevational view of an alternative embodiment of a latch.

In certain embodiments, it is contemplated that a latch using two closed apertures and specifically, two circular non-slotted apertures could be used instead of the latch 20 as described herein. Referring to FIG. 11, an alternative embodiment latch 220 is depicted. The latch 220 defines a forwardly directed nose surface 228 and an oppositely directed rear surface 230. The latch 220 also defines a first aperture 224 and a second aperture 226. The latch 220 can be used and incorporated within a tool head as described herein by inserting the second latch pin 140 within the second aperture 226. Instead of disposing the first latch pin 130 within the first aperture 224, a variety of alternative securing provisions are contemplated. Examples of such securing provisions for engagement with the first aperture 224 include, but are not limited to, a retaining clip, a threaded fastener such as a screw, and/or various male members that could be releasably engaged in the aperture 224 and within corresponding apertures in the frame members.

It is contemplated that in certain embodiments, one or more optional housing member(s) can be used for attachment to an outer face of a frame member. In many versions of the tool heads, two housing members could be used to enclose a tool head assembly. It will be appreciated that the present subject matter includes tool heads free of housing member(s) such as shown in the referenced figures.

Figure 12:
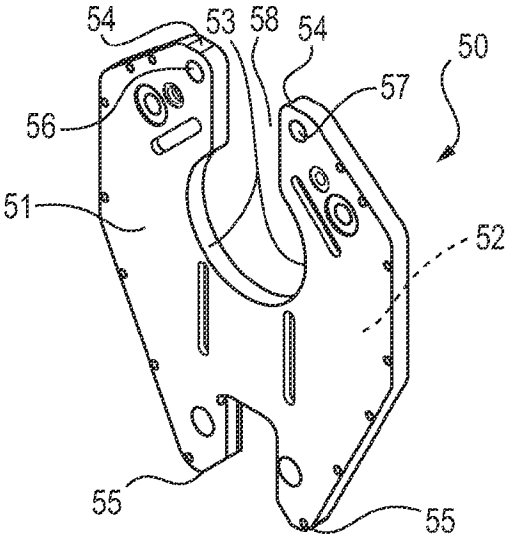
FIG. 12 is a perspective view of a frame member of the tool head.

FIG. 12 is a perspective view of a frame member such as frame member 50 used in the tool head 10. The frame member 50 defines a nose region generally including two nose regions 54 as shown. The frame member 50 also defines a rear end 55 generally including two rear end regions 55 as shown. The frame member 50 also defines an interior access region 53 which is accessible via an access channel 58 extending between the nose 54 and the interior region 53. In certain embodiments, the access channel 58 is disposed between a pair of nose regions 54 as shown in FIG. 12. The frame member 50 also defines two locations or apertures at which are secured or otherwise retained, the latch pins. Specifically, the frame member 50 defines a first latch pin location 56 proximate one nose region 54 and a second latch pin location 57 proximate another nose region 54. The first latch pin location 56 receives the first latch pin 130. The second latch pin location 57 receives the second latch pin 140. The frame member 50 defines an inner face 51 and an oppositely directed outer face 52. It will be appreciated that the frame member 40 typically has a similar configuration, e.g. shape and size, as the frame member 50.

Figure 13:
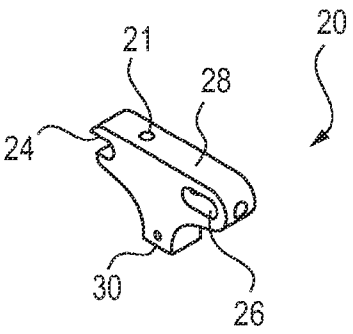
FIG. 13 is a perspective view of the selectively positionable latch member.

FIG. 13 is a perspective view of the latch 20.

Figure 14:
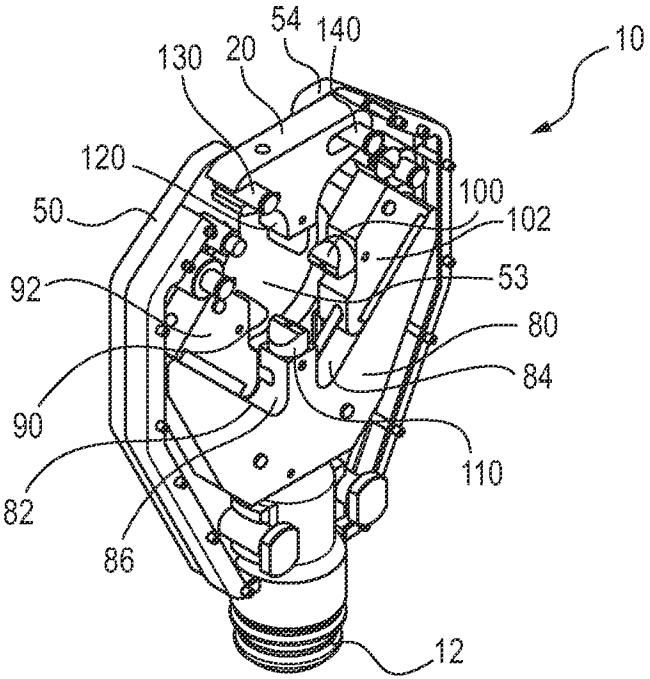
FIG. 14 is a perspective view of an interior of the tool head having one frame member removed thereby revealing another frame member, a ramp member, two opposing slidable indenter bases and indenters, a primary indenter and a supplemental indenter and positionable latch.

The tool head 10 can utilize a variety of indenter assemblies and other mechanical assemblies to provide a crimping or compression function. FIG. 14 illustrates a representative assembly for the tool head 10. The latch 20 is shown in a closed position. Moveably positioned between the frame members is a ramp member 80. The ramp member defines two opposing inclined ramp surfaces 82 and 84. A pair of indenter bases 92 and 102 are disposed on the ramp surfaces 82 and 84, respectively. As will be understood, the tool head 10 is actuated by displacing the ramp member 80 relative to the frame members and toward the nose region of the frame members. Thus, referring to FIG. 14, upon displacement of the ramp member 80 toward the nose 54 of the frame member 50, each of the indenter bases 92 and 102, carrying indenters 90 and 100, respectively, are displaced toward one another and toward the interior access region 53 defined by the frame member 50, due to the inclined ramp surfaces 82 and 84. The ramp member 80 also includes an outwardly extending member 86 which serves as a base for the primary indenter 110. And, the latch 20 can carry the supplemental indenter 120 positioned and engaged to the rear surface 30 of the latch 20.

Figure 15:
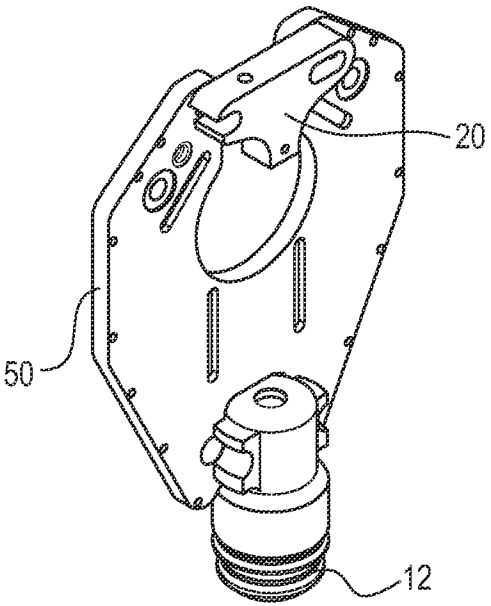
FIG. 15 is a perspective view of the interior of the tool head having the ramp member and all indenters and indenter bases removed.

FIG. 15 illustrates the assembly of FIG. 14 with all components removed except for the frame member 50, and the latch 20 to further illustrate their relative positions when the latch is in a closed position.

Figure 16:
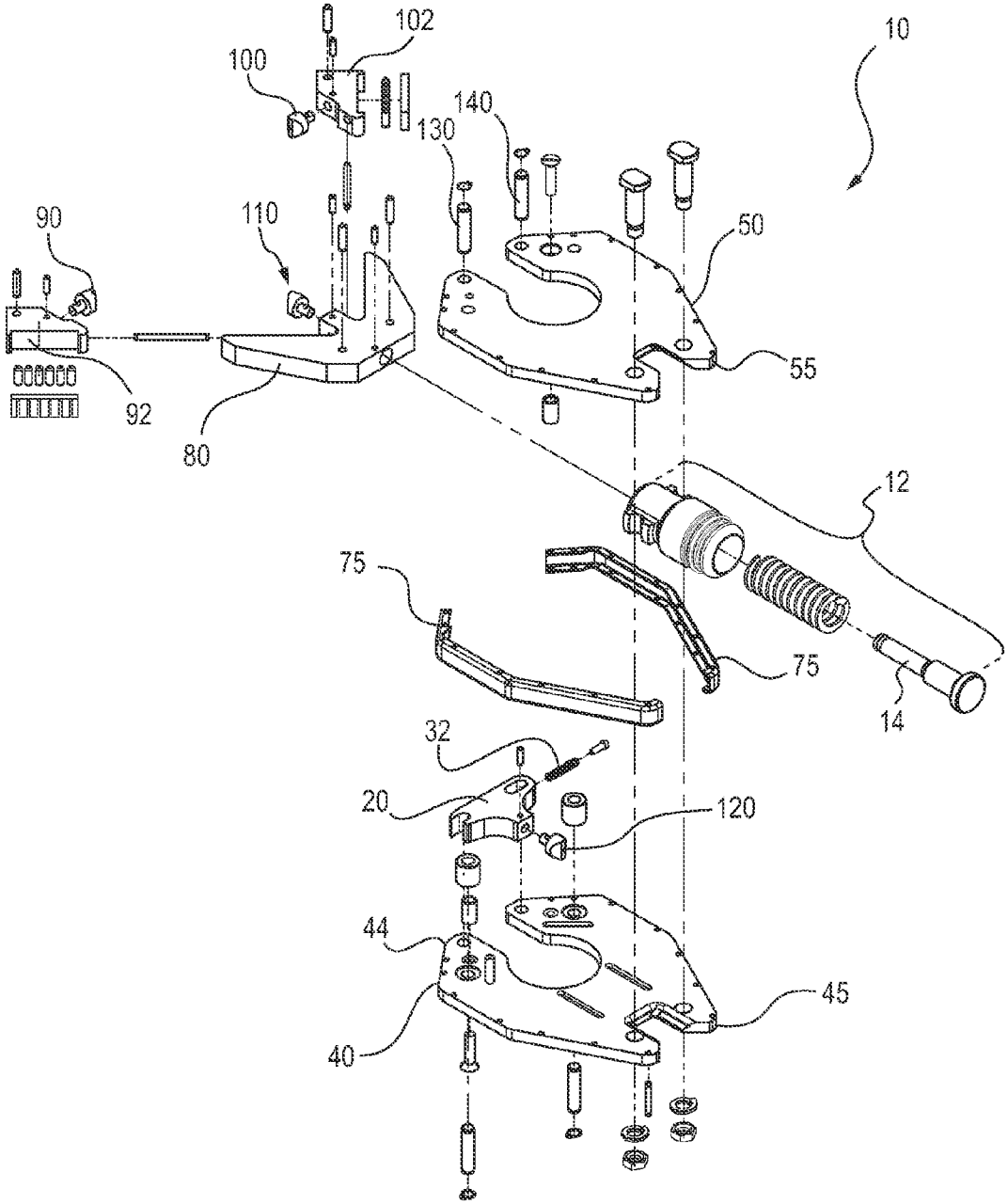
FIG. 16 is an exploded view illustrating assembly of two frame members, the ramp member, the indenters, associated indenter bases, and additional components of the tool head in accordance with the present subject matter.

FIG. 16 is an exploded view of the tool head 10 without the optional grip member 22 shown in FIG. 1. As illustrated in FIG. 16, the ramp member 80, the indenter bases 92, 102, the latch 20, and the latch pins 130, 140 are disposed between the frame members 40, 50. The base member 80 is engaged with the engagement assembly 12 which upon coupling to a tool body or other system, linearally displaces the ramp assembly 80. FIG. 16 also depicts one or more sidewalls 75 which can be positioned between and/or proximate outer regions of the frame members. The sidewalls may serve to enclose the interior region of the tool head 10 and/or promote a parallel relationship between the frame members. Referring further to FIG. 16, the indenter 90 is engaged and supported on the indenter base 92. The indenter 100 is engaged and supported on the indenter base 102. The primary indenter 110 is engaged and supported on the ramp member 80. And, the supplemental indenter 120 is engaged and supported on the latch 20. FIG. 16 also illustrates a biasing member such as a compression spring for positioning within the blind hole 27 of the latch 20 shown in FIG. 10. FIG. 16 also illustrates a piston member 14 which may be associated with the engagement assembly 12. Upon actuation or operation of a tool such as the tool 200 illustrated in FIG. 2, the piston 14 is linearly displaced and typically axially displaced, to thereby contact and also displace the ramp member 80.

The tools according to the present subject matter provide numerous advantages including a thinner and more compact size and a latch that is easier to operate. Furthermore, certain components of the tool can be formed in a less costly fashion and/or use less costly materials.

Many other benefits will no doubt become apparent from future application and development of this technology.

All patents, published applications, and articles noted herein are hereby incorporated by reference in their entirety.

As described hereinabove, the present subject matter overcomes many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A tool head comprising:

a frame assembly defining an interior hollow region and a passage extending between the interior region and an exterior of the frame assembly, the passage providing access to the interior region, the frame assembly including a first latch pin and a second latch pin, the pins disposed opposite one another and separated by the passage;

a selectively positionable latch retained along the frame assembly and proximate the passage and governing access to the interior region, the latch having a first end and a second end, an exterior face generally extending between the first end and the second end, and an interior face oppositely directed from the exterior face and generally extending between the first end and the second end, the latch defining an open aperture proximate the first end and a closed and elongated slot aperture proximate the second end, the elongated slot aperture including a pair of arcuate endwalls, a front wall, and a rear wall extending between the pair of arcuate endwalls, the latch being positionably retained along the frame assembly and proximate the passage by the second pin disposed in the closed aperture and the first pin disposed in the open aperture, wherein the latch is positionable between (i) an unsecured position in which the first pin is not disposed in the open aperture and the second pin is disposed in the closed aperture, and (ii) a closed position in which the first pin is disposed in the open aperture and the second pin is disposed in the closed aperture.

2. The tool head of claim 1 further comprising:

a plurality of indenters disposed within the interior hollow region defined by the frame assembly, a ramp member disposed within the interior hollow region defined by the frame assembly, the ramp member defining two opposing inclined ramp surfaces;

wherein at least two of the plurality of indenters are slidably disposed on the ramp surfaces.

3. The tool head of claim 2 wherein the plurality of indenters includes a primary indenter extending from the ramp member, toward the passage defined by the frame assembly.

4. The tool head of claim 2 wherein the selective plurality of indenters includes a supplemental indenter extending from the positionable latch.

5. The tool head of claim 1 wherein the selectively positionable latch defines a blind hole extending from the closed aperture toward the open aperture and accessible from the closed aperture.

6. The tool head of claim 5 further comprising a biasing member disposed in the blind hole for biasing the selectively positionable latch to the closed position.

7. The tool head of claim 1 wherein the latch is positioned from the closed position to the unsecured position by displacing the latch relative to the frame assembly, the first latch pin, and the second latch pin such that the second pin disposed in the closed aperture is displaced from one end of the closed aperture to another end of the closed aperture.

8. The tool head of claim 1 wherein the latch includes a handle extending from an exterior face of the latch.

9. A tool head having a plurality of moveable indenters which are displaced toward one another upon operation of the tool head, the tool head comprising:

a frame assembly defining an interior hollow region and a passage extending between the interior hollow region and an exterior of the frame assembly;

first and second latch pins extending from the frame assembly and disposed on opposite sides of the passage;

a selectively positionable latch defining a closed and elongated slot aperture within which the second latch pin is disposed and an open aperture within which the first latch pin can be disposed, the elongated slot aperture including a pair of arcuate endwalls, a front wall, and a rear wall extending between the pair of arcuate endwalls, wherein the latch can be positioned between (i) a closed position in which the latch extends across the passage and the first latch pin is disposed in the open aperture, and (ii) an unsecured position in which the first latch pin is not disposed in the open aperture.

10. The tool head of claim 9 wherein the latch also defines a blind hole extending from the closed aperture toward the open aperture and accessible from the closed aperture.

11. The tool head of claim 10 further comprising:

a biasing member disposed in the blind hole for biasing the latch in the closed position.

12. The tool head of claim 1 wherein the latch includes a handle extending from the latch.

13. A tool head having provisions for performing a crimping or pressing operation upon a workpiece, the tool head comprising:

a frame assembly defining an interior region for performing a crimping or pressing operation, the frame assembly also defining an access channel extending between the interior region and a nose region of the frame assembly;

a plurality of indenters disposed within the interior region defined by the frame assembly;

a ramp member disposed within the interior region defined by the frame assembly, the ramp member defining two opposing inclined ramp surfaces, wherein at least two of the plurality of indenters are slidably disposed on the ramp surfaces;

at least one latch pin secured to the frame assembly and positioned proximate the access channel defined by the frame assembly;

a selectively pivotally positionable latch defining at least one closed elongate aperture having two opposite endwalls and sized to receive at least one latch pin, the latch positioned such that the latch pin is received within the aperture defined in the latch and the latch being pivotally positionable between (i) a closed position in which the latch extends across the access channel thereby blocking the access channel and the latch pin contacts one of the endwalls of the aperture defined in the latch, (ii) an unsecured position in which the latch pin contacts another one of the endwalls of the aperture defined in the latch, and (iii) an open position in which the access channel defined by the frame assembly is not blocked by the latch.

14. The tool head of claim 13 wherein the at least one latch pin includes a first latch pin and a second latch pin.

15. The tool head of claim 14 wherein the latch further defines an open aperture accessible from a distal end of the latch.

16. The tool head of claim 15 wherein upon positioning the latch to the closed position, the second latch pin is disposed in the elongate aperture, and the first latch pin is disposed in the open aperture.

17. The tool head of claim 15 wherein upon positioning the latch to the open position, the second latch pin is disposed in the elongate aperture and the first latch pin is disposed outside of the open aperture.

18. A tool head having provisions for performing a crimping or pressing operation upon a workpiece, the tool head comprising:

a frame assembly defining an interior region for performing a crimping or pressing operation, the frame assembly also defining an access channel extending between the interior region and a nose region of the frame assembly;

at least one latch pin secured to the frame assembly and positioned proximate the access channel defined by the frame assembly;

a selectively positionable latch defining at least one closed elongate aperture having two opposite endwalls and sized to receive at least one latch pin, the latch positioned such that the latch pin is received within the aperture defined in the latch and the latch being positionable between (i) a closed position in which the latch extends across the access channel thereby blocking the access channel and the latch pin contacts one of the endwalls of the aperture defined in the latch, (ii) an unsecured position in which the latch pin contacts another one of the endwalls of the aperture defined in the latch, and (iii) an open position in which the access channel defined by the frame assembly is not blocked by the latch;

wherein the latch further defines a blind hole accessible from the elongate aperture and the latch includes a biasing member disposed in the blind hole, wherein the latch when in the unsecured position, is baised to the closed position.

* * * * *